United States Patent [19]

Donelian

[11] 3,933,416

[45] Jan. 20, 1976

[54] HERMETICALLY SEALED MOTOR BLOWER UNIT WITH STATOR INSIDE HOLLOW ARMATURE

[75] Inventor: Khatchik O. Donelian, New York, N.Y.

[73] Assignee: United States Energy Research and Development Administration, Washington, D.C.

[22] Filed: May 1, 1945

[21] Appl. No.: 591,240

[52] U.S. Cl. ..... 417/354; 310/67 R; 310/54; 310/90; 415/111; 415/112; 417/372; 417/424; 417/902

[51] Int. Cl.[2] ..... F04B 35/04

[58] Field of Search ..... 417/354, 372, 423, 424, 417/902; 415/111, 112; 310/67 R, 90, 85, 86, 87, 54, 57; 172/36

[56] References Cited

UNITED STATES PATENTS

| | | | |
|---|---|---|---|
| 1,539,195 | 5/1925 | Kremser | 310/67 R |
| 1,632,357 | 6/1927 | White | 417/354 |
| 1,820,985 | 9/1931 | McKee | 310/67 R |
| 2,193,531 | 3/1940 | Esual | 310/67 R |
| 2,225,338 | 12/1940 | Geiss | 417/354 |
| 2,430,843 | 11/1947 | Colwell | 310/67 R |

*Primary Examiner*—Charles A. Ruehl
*Attorney, Agent, or Firm*—Dean E. Carlson, Leonard Belkin

EXEMPLARY CLAIM

13. A hermetically sealed motor blower unit comprising, in combination, a sealed housing having a thrust plate mounted therein and having a re-entrant wall forming a central cavity in said housing, a rotor within said housing, said rotor comprising an impeller, a hollow shaft embracing said cavity and a thrust collar adapted to cooperate with said thrust plate to support the axial thrust of said shaft, one or more journal bearings within said housing for supporting the radial load of said shaft and electric motor means for rotating said rotor, said motor means comprising a motor-stator located within said cavity and adapted to cooperate through a portion of said re-entrant wall with a motor-rotor mounted within said hollow shaft, the portion of said re-entrant wall located between said motor-stator and said motor-rotor being made relatively thin to reduce electrical losses, the bearing surfaces of said thrust plate, thrust collar and journal bearings being in communication with the discharge of said impeller, whereby fluid pumped by said impeller can flow directly to said bearing surfaces to lubricate them.

13 Claims, 3 Drawing Figures

INVENTOR
KHATCHIK O. DONELIAN

BY
Robert A. Lavender
ATTORNEY

INVENTOR
KHATCHIK O. DONELIAN
BY
Robert A. Lorender
ATTORNEY

HERMATICALLY SEALED MOTOR BLOWER UNIT WITH STATOR INSIDE HOLLOW ARMATURE

This invention relates to electric motors and more particularly to improvements in a so-called "inside-out" motor, i.e. a motor of the type having a hollow rotor and a stator located within the central cavity of the hollow rotor. The motor of the present invention possesses particular advantages when incorporated in a motor blower unit for pumping a corrosive gas under reduced pressure and will be illustratively described as applied to this problem. However as the description proceeds it will become apparent that the present motor is not limited to this application but may be used with advantage for a wide variety of other purposes, some of which are indicated hereinafter.

In recent years there has been a considerable interest in the separation of the different isotopes of some of the chemical elements, notably the separation of the uranium isotopes, and a brief discussion of certain of the problems encountered in effecting such a separation will serve to illustrate the utility of the present motor. The separation of isotopes and particularly of the uranium isotopes is an exceedingly complicated problem. Numerous methods have been proposed for accomplishing such a separation and substantially all of them require the use of a uranium compound that may be maintained in gaseous form. The most easily available uranium compound that will meet these requirements is the hexafluoride which is a solid at ordinary temperatures but sublimes at about 60°C and thus may be easily vaporized.

One of the preferred methods of separating isotopes is the so-called diffusion method wherein the isotopic mixture in gaseous form is passed over the surface of a finely porous, permeable membrane and a portion of the gas is caused to diffuse through the membrane to yield a product that is enriched with respect to the lighter component of the mixture. In carrying out the diffusion method large quantities of gas must be handled at relatively low pressures and a diffusion separation system must include suitable pumps for handling this large quantity of gas.

In pumping highly corrosive gases such as uranium hexafluoride a number of special problems arise that are not ordinarily encountered in handling non-corrosive gases. Uranium hexafluoride attacks chemically all of the common lubricants and packing materials thereby destroying their lubricating and sealing properties. Furthermore the reaction products produced as a result of the chemical interaction between the corrosive gas and the lubricant may contaminate the gas being pumped. Accordingly any pump that is to be used for pumping such a corrosive gas should be so constructed that there is no contact between the lubricant and the gas being pumped.

It has been previously proposed that this problem be solved by providing a sealed motor blower unit wherein the pump impeller and rotor of an electric motor are encased in a sealed housing and the stator of the electric motor is so located outside the housing that the rotor cooperates with the stator through a relatively thin diaphragm to rotate the rotor and associated pump impeller. The rotor and impeller are supported in gas-lubricated thrust and journal bearings located within the sealed casing and lubricated by the gas being pumped. A motor blower unit of this type is disclosed in a co-pending application of John R. Menke, Ser. No. 537,457, filed May 26, 1944.

Such motor blower units are subject to a number of disadvantages which limit their effectiveness to a certain extent. Thus from the point of view of operating efficiency of the electric motor that drives the pump impeller it is desirable that the diaphragm between the rotor and stator be made relatively thin. However when the unit is operated at pressures substantially less than atmospheric pressure the diaphragm must be strong enough to withstand the external pressure of the atmosphere without collapsing and therefore under these conditions cannot be made as thin as it should be for efficient operation of the motor.

Another disadvantage of the previously proposed construction is that it is somewhat difficult to cool the rotor satisfactorily. The rotor is commonly made relatively large in order to provide the desired stability when operating with gas-lubricated bearings and since the rotor is located within a sealed casing it tends to overheat. This tendency to overheat makes it necessary to use a larger driving motor to obtain the same useful power. This effect is particularly disadvantageous in the case of a gas-lubricated unit which desirably operates at relatively high speeds.

It is accordingly an object of the present invention to provide an improved motor adapted to be more effectively incorporated in a sealed motor pump unit for handling corrosive fluids.

It is another object of the invention to provide an electric motor adapted to be more effectively incorporated in a motor blower unit for handling gases at relatively low absolute pressures.

It is a further object of the invention to provide an improved gas-lubricated electric motor.

It is still another object of the invention to provide an improved "inside-out" motor.

It is a still further object of the invention to provide a gas-lubricated motor having improved operating stability.

It is still another object of the invention to provide an electric motor which is compact in construction and efficient in operation.

It is still another object of the invention to provide a sealed motor in which the interior parts are readily accessible for maintenance or repair.

Other objects of the invention will be in part obvious and in part pointed out hereinafter.

The many objects and advantages of the invention may be best understood by referring to the accompanying drawings which illustrate a motor blower unit incorporating a preferred embodiment of the present invention and wherein FIG. 1 is a vertical axial section showing the relative arrangement of the stator and rotor of the electric motor and the pump impeller.

Figure 1:
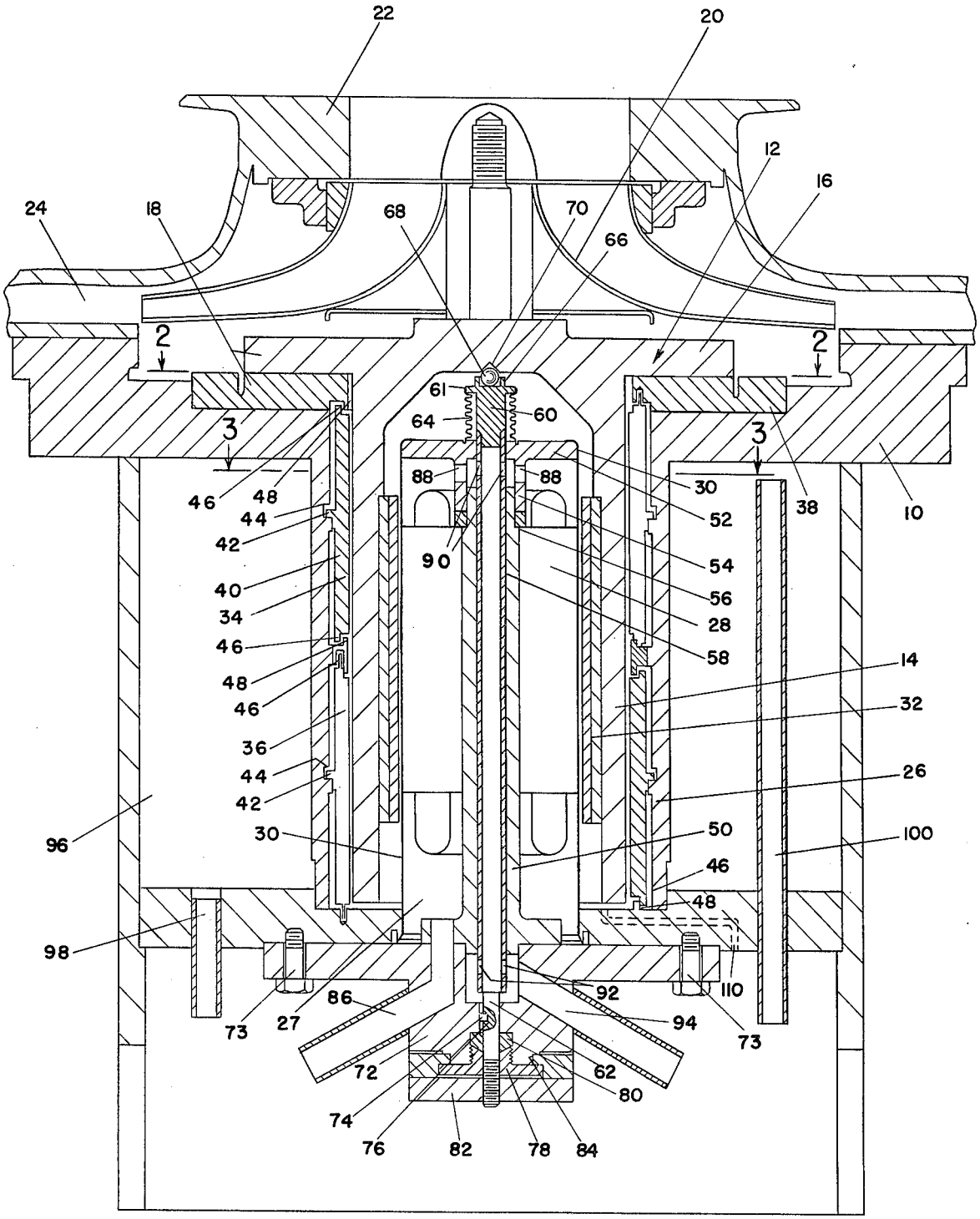

Referring to the drawings and more particularly to FIG. 1, there is shown a motor blower unit comprising generally a sealed gas-tight casing 10 and a rotor 12 adapted to rotate about a vertical axis. The rotor 12 comprises a hollow open-ended shaft 14 located in a well 26 of the casing, a thrust collar 16 which forms a part of a thrust bearing 18 and has a plane annular bearing surface on its underside and an impeller 20 located in the upper part of the casing. The gas to be pumped is drawn into the casing centrally through a flanged inlet 22 and flows through the vanes of impeller 20 to a discharge passage 24. The rotating impeller 20 cooperates with the passage 24 to compress and pump the gas flow therethrough.

The bottom of well 26 has a re-entrant wall which forms a central cavity 27 within the open end of hollow shaft 14. The re-entrant wall comprises a thin, cylindrical diaphragm 30 which at its lower end is sealed to the bottom of well 26 and a disc or collar 52 to which the upper end of the diaphragm 30 is sealed. At its lower end the cavity 27 is closed by a flanged block 72 which is fixed to the bottom of casing 10 in any suitable manner such as by the bolts 73. Mounted within the cavity 27 there is a motor-stator 28 which cooperates through diaphragm 30 with a motor-rotor comprising a plurality of rotor bars 32 mounted on the interior surface of the hollow shaft 14. (The terms motor-rotor and motor-stator are used in the following description and claims to designate respectively the electrically active rotating and electrically active stationary portions of the present construction.) In order to reduce electrical losses diaphragm 30 may be made of a metal having a high electrical resistance such as Monel or a nichrome metal or it may be made of a suitably attached non-conductor. The motor-stator 28 is mounted on a central tubular core 50 which is in turn mounted on the block 72. Near its upper end the core 50 is cut away to form an annular shoulder 56 on which rests a depending flange 54 of the collar 52, the construction being such that the core 50 provides support for the collar 52 and also provides support for the relatively thin diaphragm 30.

Figure 2:
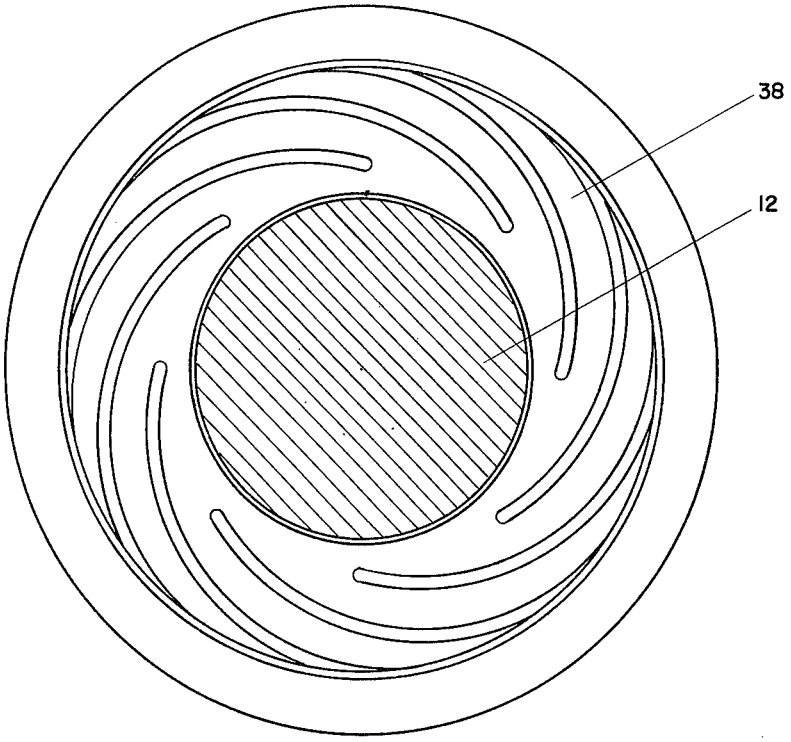
FIG. 2 is a horizontal section taken on the line 2—2 of FIG. 1 and showing the upper surface of the thrust plate.

The rotor 12 receives its principal vertical support from the thrust bearing 18 and is laterally guided by the journal bearings 34 and 36 located within the well 26. The thrust bearing 18 comprises in addition to the thrust collar 16 a thrust plate 38 which (see FIG. 2) is provided with a series of curved grooves extending inwardly in an arc from the periphery of the thrust plate 38. The construction of the thrust collar 16 and thrust plate 38 is such that as the rotor 12 rotates the plane bearing surface of the thrust collar 16 cooperates with the grooved bearing surface of the thrust plate 38 to cause a portion of the gas being pumped by impeller 20 to be drawn between the thrust bearing surfaces and forced into the well 26. In this manner the thrust bearing surfaces are lubricated by the gas being pumped and an elevated gas pressure is built up within the well 26.

Figure 3:
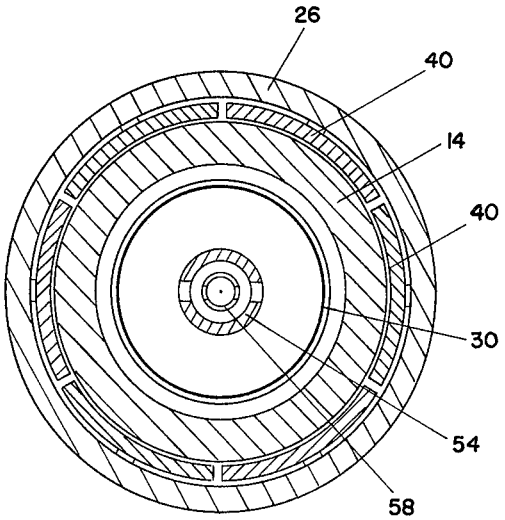
FIG. 3 is a horizontal section taken on the line 3—3 of FIG. 1 and showing certain details of the arrangement of the journal bearings with respect to the rotor.

The radial thrust of the rotor 12 is supported by the gas-lubricated journal bearings 34 and 36. The shaft 14 is provided with an external bearing surface and the shaft itself forms a journal of the bearings 34 and 36. Referring to FIGS. 1 and 3 the bearings 34 and 36 are similar in construction and each comprises a plurality (in this case 6) of bearing shoes 40 that are tiltable about a vertical axis. The shoes 40 have bearing surfaces confronting the external bearing surface of the shaft 14 and cooperate therewith to support the radial thrust of the shaft and rotor. Each shoe is provided at its outer surface with a projection 42 which rests in a notch 44 of the well 26 to provide vertical support for the shoe. Additional support for the shoes 40 is provided at their upper and lower ends by the projecting portions 46 which cooperate with the retaining shoulders 48 of the casing 10 to hold the bearing shoes in place. The shoes 40 are so mounted that they are free to tilt and thus adjust themselves to the proper position with respect to the bearing surface of the rotor 12.

In order to reduce the starting torque required to initiate rotation of the rotor 12 and prevent possible damage to the thrust bearing surfaces of the thrust bearing 18 means are provided for temporarily lifting the rotor until the rotor speed is great enough to cause a sufficient quantity of gaseous lubricant to be drawn between the thrust bearing surfaces to sustain the weight of the rotor. Within the tubular core 50 and axially slidable with respect thereto there is a rotor lifting tube 58 which at its upper end is provided with a solid head 60 and at its lower end has a rod-like extension 62. The head 60 has an upper peripheral flange 61 to which is sealed one end of a flexible bellows 64, the lower end of the bellows 64 being sealed to the top of collar 52. The function of the bellows is to prevent leakage from the cavity 27 into the interior of the sealed casing while permitting axial movement of the tube 58.

On the upper surface of head 60 there is formed a small well 66 which is so constructed as to receive and retain a ball bearing 68 that is adapted to fit into a conical notch 70 formed in the rotor 12. The arrangement is such that as the lifting tube 58 is moved upwardly the rotor 12 and more particularly the thrust collar 16 is lifted off of the thrust plate 18 and the weight of the rotor is supported on the ball bearing 68.

Means for moving the tube 58 upward to lift the rotor 12 are provided near the bottom of the casing 10. The rod-like extension 62 of the lifting tube 58 extends downwardly through the block 72. In order to seal the cavity 27 and prevent leakage therefrom past the extension 62 a packing is provided around the extension comprising a packing nut 78 which is threaded into the block 72 and bears against a suitable packing 80. Formed in the extension 62 there is a keyway 76 having slidable therein a key 74 that is fixed to the block 72 in such manner as to prevent rotational movement of the extension 62 and lifting tube 58 while permitting axial movement of the tube and extension.

The lower end of extension 62 is threaded to cooperate with a nut 82 in such manner that rotation of nut 82 produces axial movement of the extension 62 and consequently of the tube 58. Nut 82 has an inwardly extending flange 84 which cooperates with the peripheral portion of packing nut 78 to prevent axial movement of the nut 82 while permitting rotation thereof. Thus by rotation of nut 82 the tube 58 may be raised to cause the rotor 12 to be lifted to such an extent that the weight of the rotor is carried on the ball bearing 68. When the machine has come up to speed the nut 82 may be rotated in the opposite direction to lower the tube 58 and permit the rotor to be carried on the thrust bearing 18.

In order to cool the motor-stator 28 and also the shaft portion 14 of the rotor as well as the motor-rotor a suitable coolant such as water or oil is supplied to the central cavity 27. The coolant is introduced through a conduit 86 in block 72, flows upwardly around the motor-stator windings, thence through holes 88 in the flange 54 and holes 90 in the tube 58. Coolant flows down through tube 58 and then through holes 92 in the bottom of tube 58 and out through conduit 94 of block 72. As stated the coolant cools the motor-stator windings and also through the diaphragm 30 the motor-rotor 32 and shaft 14.

The outside of well 26 is also cooled. Surrounding the well 26 there is a coolant chamber 96, into which coolant is introduced through a conduit 98. The coolant flows in a generally upward direction through the chamber 96 and then flows out of the chamber through a conduit 100. The coolant flowing through the chamber 96 aids in cooling the journal bearings 34 and 36 and the shaft 14.

As previously indicated the motor blower unit described above may be used with particular advantage in pumping a highly corrosive gas, for example uranium hexafluoride, at pressures substantially below atmospheric pressure. The rotor 12 which includes a pump impeller 20 is completely sealed from the outside atmosphere as well as from the coolant and the casing, and the rotor may be made of materials resistant to the action of the corrosive gas. The pressure within the cavity 27 will normally be maintained at a value somewhat above atmospheric pressure and thus when the motor blower unit is used to pump a gas at a reduced pressure the pressure within diaphragm 30 will be greater than the pressure at the outer surface of the diaphragm, i.e. the pressure within the well 26 of the casing 10. Thus the diaphragm 30 in the present construction may be made much thinner than it could be when using the prior constructions wherein the greater pressure is exerted against the outside of the diaphragm and therefore the diaphragm must be made relatively heavy to prevent its collapse. The reduction in the thickness of the diaphragm that may be made when using the present construction substantially increases the operating efficiency of the motor.

A further advantage of the present motor construction arises out of the improved cooling that is obtainable. The coolant supplied to the cavity 27 cools the interior of the rotor 12 and the coolant supplied to chamber 96 cools the exterior of the rotor. Thus unusually effective cooling is obtained with the result that the efficiency of the motor is further improved and the impeller may be driven at the same speed with a relatively smaller motor or, if desired, at a higher speed with the same size motor.

A still further advantage of the present construction is the improved stability that is obtained. By locating the motor-stator within the rotor (as well as within the motor-rotor) a relatively large proportion of the exterior surface of the rotor may be used as the bearing surface of the journal bearings that support the radial thrust of the rotor. The journal bearings may be located closely adjacent one another and the rotor made relatively compact in construction so that a proportionately large bearing area compared to the total rotor mass is available for supporting the radial thrust of the rotor. In this way the stability of the rotating shaft and associated impeller may be substantially improved. This feature is of considerable importance in the case of gas-lubricated bearings where the attainment of desired stability presents a difficult problem. In such gas-lubricated bearings the tendency of the shaft to "whip" is very difficult to overcome. As the mass of the rotor increases "whip" tends to occur at lower speeds of rotation. Hence the present construction, wherein there is a relatively high ratio of bearing area to rotor mass, permits the use of higher speeds of rotation without undesirable "whip."

Still another advantage of the present construction is that the interior parts of the unit such as the motor-stator 28 are easily accessible for repairs. Such repairs may be effected simply by removing the bolts 73 and the flanged block 72.

It is to be understood that the foregoing description is illustrative only and that many changes might be made in the specific embodiment described. Thus, for example, the motor-rotor need not be a series of bars but may be a continuous sleeve of a conductive material such as copper or aluminum. Fixed journal shoes or a solid journal bearing may be used in place of the tiltable shoes 40. The lifting of the rotor during the starting up period may be effected by introducing a gas under pressure into the well 26 in any suitable manner as through the conduit 110 (see FIG. 1). Other variations will be apparent to those skilled in the art.

I claim:

1. An electric motor comprising, in combination, a hollow rotor having an external bearing surface, a motor-stator located within said hollow rotor, a plurality of tiltable bearing shoes having bearing surfaces confronting the external bearing surface of said rotor and adapted to cooperate therewith to support the radial thrust of said rotor, said bearing shoes being radially opposite at least a part of said motor-stator and a motor-rotor mounted on said rotor in operative relationship with respect to said motor-stator, said motor-rotor and said motor-stator cooperating to rotate said rotor.

2. An electric motor comprising, in combination, a sealed housing having a thrust plate formed therein and having a re-entrant wall forming a central cavity in said housing, a rotor mounted within said housing, said rotor comprising a motor-rotor embracing said central cavity and a thrust collar adapted to cooperate with said thrust plate to support the axial thrust of said rotor and a motor-stator mounted in said cavity for cooperating with said motor-rotor to rotate said rotor, the portion of said re-entrant wall between said motor-stator and motor-rotor being made relatively thin to minimize electrical losses in said motor.

3. An electric motor comprising, in combination, a sealed housing having a thrust plate formed therein and having a re-entrant wall forming a central cavity in said housing, a rotor mounted within said housing, said rotor comprising a motor-rotor embracing said central cavity and a thrust collar adapted to cooperate with said thrust plate to support the axial thrust of said rotor, a journal bearing within said housing for supporting the radial load of said rotor, and a motor-stator located within said central cavity and cooperating through a portion of said re-entrant wall with said motor-rotor to rotate said rotor, the portion of said re-entrant wall between said motor-stator and motor-rotor being made relatively thin to reduce electrical losses.

4. An electric motor comprising, in combination, a sealed housing having a thrust plate formed therein and having a re-entrant wall forming a central cavity in said housing, said thrust plate having a recessed bearing surface, a rotor mounted within said housing, said rotor comprising a motor-rotor embracing said cavity and a thrust collar having a bearing surface adapted to cooperate with said recessed bearing surface to support the axial thrust of said rotor, one or more journal bearings within said housing for supporting the radial load of said rotor, and a motor-stator mounted within said cavity and adapted to cooperate through a relatively thin portion of said re-entrant wall with said motor-rotor to rotate said rotor.

5. An electric motor comprising, in combination, a sealed housing having a thrust plate mounted therein and having a re-entrant wall forming a central cavity in said housing, a rotor mounted within said housing for rotation about a vertical axis, said rotor comprising a motor-rotor embracing said cavity and a thrust collar adapted to cooperate with said thrust plate to form a thrust bearing supporting said rotor, a motor-stator mounted within said cavity and adapted to cooperate through a relatively thin portion of said re-entrant wall with said motor-rotor to rotate said rotor, and lifting means for temporarily lifting said rotor until the speed of said rotor is sufficient to cause said thrust bearing to support said rotor.

6. An electric motor comprising, in combination, a sealed housing having a thrust plate mounted therein and having a re-entrant wall forming a central cavity in said housing, a rotor mounted within said housing for rotation about a vertical axis, said rotor comprising a motor-rotor embracing said cavity and a thrust collar adapted to cooperate with said thrust plate to form a thrust bearing supporting said rotor, a motor-stator mounted within said cavity and adapted to cooperate through said re-entrant wall with said motor-rotor to rotate said rotor, lifting means for temporarily lifting said rotor until the speed of said rotor is sufficient to cause said thrust bearing to support said rotor, said lifitng means comprising a ball bearing adapted to support said rotor, a vertically movable supporting member for supporting said ball bearing, and means for moving said supporting member up and down to cause said ball bearing to engage and disengage said rotor as desired.

7. An electric motor comprising, in combination, a sealed housing having a thrust plate formed therein and having a re-entrant wall forming a central cavity in said housing, a rotor within said housing, said rotor comprising a motor-rotor embracing said re-entrant wall and a thrust collar adapted to cooperate with said thrust plate to support the axial thrust of said rotor, a motor-stator within said cavity adapted to cooperate through a portion of said re-entrant wall with said motor-rotor to rotate said rotor; and cooling means for cooling said motor-stator and through said re-entrant wall said rotor.

8. An electric motor comprising, in combination, a sealed housing having a thrust plate formed therein and having a re-entrant wall forming a central cavity in said housing, a rotor within said housing, said rotor comprising a motor-rotor embracing said re-entrant wall and a thrust collar adapted to cooperate with said thrust plate to support the axial thrust of said rotor, a motor-stator within said cavity adapted to cooperate through a relatively thin portion of said re-entrant wall with said motor-rotor to rotate said rotor, and cooling means for cooling said motor-stator, said cooling means comprising a coolant supply conduit for supplying a coolant to the interior of said cavity and to said motor-stator and an axial tube for removing said coolant from the inner portion of said cavity.

9. An electric motor comprising, in combination, a sealed housing having a re-entrant wall forming a central cavity in said housing, a hollow shaft located in a well of said housing and partially embracing said cavity, motor means for rotating said shaft, said motor means comprising a motor-stator located within said cavity, a motor-rotor mounted on the inner surface of said hollow shaft and a relatively thin diaphragm forming part of said re-entrant wall and located between said motor-stator and motor-rotor, first cooling means for cooling said cavity and through said diaphragm said shaft, and second cooling means for cooling the exterior of said wall and through said wall said shaft.

10. An electric motor comprising, in combination, a sealed housing having a re-entrant wall forming a central cavity in said housing, a hollow shaft located in a well of said housing and partially embracing said cavity, motor means for rotating said shaft, said motor means comprising a motor-stator located within said cavity, a motor-rotor mounted on the inner surface of said hollow shaft and a relatively thin diaphragm forming part of said re-entrant wall and located between said motor-stator and motor-rotor, first cooling means comprising a coolant supply conduit for supplying a coolant to the interior of said cavity and to said motor-stator and an axial tube extending into said cavity for removing coolant from the interior of said cavity, and second cooling means comprising a chamber formed in said housing adjacent said well and coolant inlet and outlet means for supplying coolant to said chamber, said first and second cooling means cooperating to cool said hollow shaft from both the inside and outside thereof.

11. A hermetically sealed motor blower unit comprising, in combination, a sealed housing having a thrust plate formed therein and having a re-entrant wall forming a central cavity in said housing, a rotor mounted within said housing, said rotor comprising an impeller, a motor-rotor embracing said cavity and a thrust collar adapted to cooperate with said thrust plate to support the axial thrust of said rotor, electric motor means for rotating said rotor, said motor means comprising said motor-rotor, a motor-stator positioned within said cavity and a relatively thin diaphragm forming part of said re-entrant wall and located between said motor-stator and said motor-rotor, the bearing surfaces of said thrust plate and thrust collar being in free communication with the discharge of said impeller, whereby fluid pumped by said impeller can flow directly to said bearing surfaces to lubricate them.

12. A hermetically sealed motor blower unit comprising, in combination, a sealed housing having a thrust plate formed therein and having a re-entrant wall forming a central cavity in said housing, a rotor mounted within said housing, said rotor comprising an impeller, a hollow shaft embracing said cavity and a thrust collar adapted to cooperate with said thrust plate to support the axial thrust of said shaft, and electric motor means for rotating said rotor, said motor means comprising a motor-stator within said cavity, a motor-rotor mounted in said rotor, and a relatively thin diaphragm forming part of said re-entrant wall and located between said motor-stator and motor-rotor, the bearing surfaces of said thrust plate and thrust collar being in free communication with the discharge of said impeller, whereby fluid pumped by said impeller can flow directly to said bearing surfaces to lubricate them.

13. A hermetically sealed motor blower unit comprising, in combination, a sealed housing having a thrust plate mounted therein and having a re-entrant wall forming a central cavity in said housing, a rotor within said housing, said rotor comprising an impeller, a hollow shaft embracing said cavity and a thrust collar adapted to cooperate with said thrust plate to support the axial thrust of said shaft, one or more journal bearings within said housing for supporting the radial load of said shaft and electric motor means for rotating said rotor, said motor means comprising a motor-stator located within said cavity and adapted to cooperate through a portion of said re-entrant wall with a motor-rotor mounted within said hollow shaft, the portion of said re-entrant wall located between said motor-stator and said motor-rotor being made relatively thin to reduce electrical losses, the bearing surfaces of said thrust plate, thrust collar and journal bearings being in communication with the discharge of said impeller, whereby fluid pumped by said impeller can flow directly to said bearing surfaces to lubricate them.

* * * * *